US009010556B2

(12) United States Patent
Benson

(10) Patent No.: US 9,010,556 B2
(45) Date of Patent: Apr. 21, 2015

(54) BOTTLE CAP APPARATUS

(71) Applicant: Emil Benson, Long Beach, CA (US)

(72) Inventor: Emil Benson, Long Beach, CA (US)

( * ) Notice: Subject to any disclaimer, the term of this patent is extended or adjusted under 35 U.S.C. 154(b) by 0 days.

(21) Appl. No.: 13/909,577

(22) Filed: Jun. 4, 2013

(65) Prior Publication Data

US 2014/0353274 A1 Dec. 4, 2014

(51) Int. Cl.
*B65D 41/04* (2006.01)
*B65D 41/02* (2006.01)

(52) U.S. Cl.
CPC ..... *B65D 41/0435* (2013.01); *B65D 41/04* (2013.01); *B65D 41/02* (2013.01)

(58) Field of Classification Search
CPC .... B65D 45/325; B65D 45/322; B65D 45/32; B65D 41/0435; B65D 41/04; B65D 41/02
USPC ..... 215/272, 298, 296, 295, 305, 320, 359, 215/361, 364, 358, 355, 356; 220/298, 302, 220/301, 293, 288, 281, 284, 326, 324, 315, 220/789, 212; 81/3.45, 3.48, 3.41, 3.4
See application file for complete search history.

(56) References Cited

U.S. PATENT DOCUMENTS

| | | | | | |
|---|---|---|---|---|---|
| 52,379 | A | * | 2/1866 | Bennett | 215/307 |
| 992,928 | A | * | 5/1911 | Walcott | 215/356 |
| 1,810,795 | A | * | 6/1931 | Soderquist | 81/3.48 |
| 1,818,626 | A | * | 8/1931 | Johnston | 81/3.48 |

FOREIGN PATENT DOCUMENTS

CH 669368 A5 * 3/1989 ..... B65D 55/06

OTHER PUBLICATIONS

Translation of CH669368, (Vonlanthen), Mar. 15, 1989, pp. 3-4, 8.*

* cited by examiner

*Primary Examiner* — Robert J Hicks
(74) *Attorney, Agent, or Firm* — John D. Tran; Rhema Law Group, P.C.

(57) ABSTRACT

A bottle cap apparatus for operating in conjunction with a bottle having a mouth, the apparatus comprising a receiver for engaging the mouth of the bottle and an insert assembly configured to be removably engaged with the receiver so as to selectively open and close the mouth of the bottle.

14 Claims, 6 Drawing Sheets

BOTTLE CAP APPARATUS

RELATED APPLICATIONS

Not applicable.

INCORPORATION BY REFERENCE

Applicant(s) hereby incorporate herein by reference any and all patents and published patent applications cited or referred to in this application.

BACKGROUND OF THE INVENTION

1. Field of the Invention

Aspects of this invention relate generally to bottles, and more particularly to bottle cap devices for fitting within the mouths of bottles.

2. Description of Related Art

By way of background, bottles, canteens, and other such vessels for containing water or other fluids most often are equipped or formed at their mouth or opening with internal or external threads for threadably receiving a cap and thereby selectively opening or closing the bottle. In the case of such threaded caps, two hands are basically required to open or close the bottle—one to hold the bottle and one to operate or twist the cap—typically taking on the order of five seconds or more to screw or unscrew the cap. In alternative arrangements, a drinking straw or other such opening is provided within or through the cap for sucking fluid from the bottle, but this can limit the rate of consumption and potentially creates other hygiene issues. Aspects of the present invention fulfill these needs and provide further related advantages as described in the following summary.

SUMMARY OF THE INVENTION

Aspects of the present invention teach certain benefits in construction and use which give rise to the exemplary advantages described below.

The present invention solves the problems described above by providing a bottle cap apparatus that provides a means to more quickly and easily open and close the mouth of a bottle without appreciably limiting flow rate through the mouth and without raising cleaning and hygiene concerns. The apparatus provides, in the exemplary embodiment, a receiver configured with a means for engaging the mouth of the bottle and an insert assembly configured to be removably engaged with the receiver so as to selectively open and close the mouth of the bottle.

A primary objective inherent in the above described apparatus and method of use is to provide advantages not taught by the prior art.

Another objective is to provide such an apparatus wherein the receiver comprises a receiver annular wall having a receiver annular wall inner surface formed with a circumferential groove.

A still further objective is to provide such an apparatus wherein the insert assembly comprises a latch having a latch base formed with at least one resilient tine extending substantially upwardly and outwardly therefrom and terminating in a substantially radially-outwardly projecting tip, the tip being configured to seat within the groove and thereby selectively secure the insert assembly within the receiver.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION OF THE INVENTION

The above described drawing figures illustrate aspects of the invention in at least one of its exemplary embodiments, which are further defined in detail in the following description.

Figure 1:
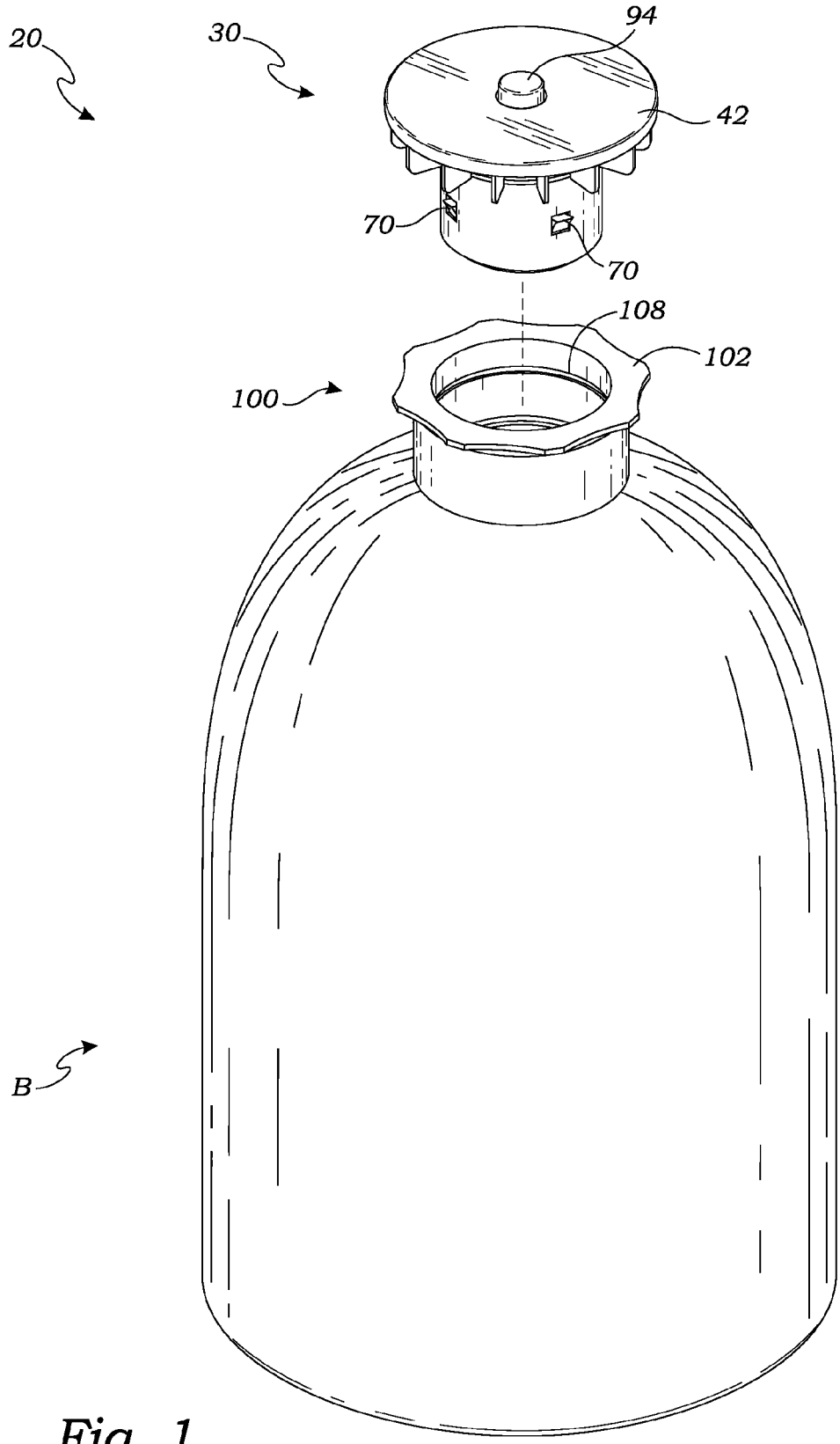
FIG. 1 is a partially exploded perspective view of an exemplary bottle cap apparatus, in accordance with at least one embodiment, as installed in the mouth of a bottle.

Turning now to FIG. 1, there is shown a partially-exploded perspective view of an exemplary embodiment of a bottle cap apparatus 20 according to aspects of the present invention. The apparatus 20 comprises, in one embodiment, a receiver 100 configured to be removably engaged with the mouth M (FIG. 2) of a bottle B and an insert assembly 30 configured to be removably engaged with the receiver 100 as shown and described further herein. As best seen in the enlarged fully-exploded perspective view FIG. 2, the receiver 100 is shown as having external or male threads 112 configured to engage corresponding internal or female threads T formed within the bottle mouth M. While such a male-female thread form engagement means is thus shown, it will be appreciated that the thread forms may be reversed such that the internal or female threads are formed on the receiver 100 and the external or male threads are formed on the bottle mouth M, and it will be further appreciated that other engagement means between the bottle mouth M and the receiver 100 beyond a threadable engagement are possible without departing from the spirit and scope of the invention.

Figure 2:
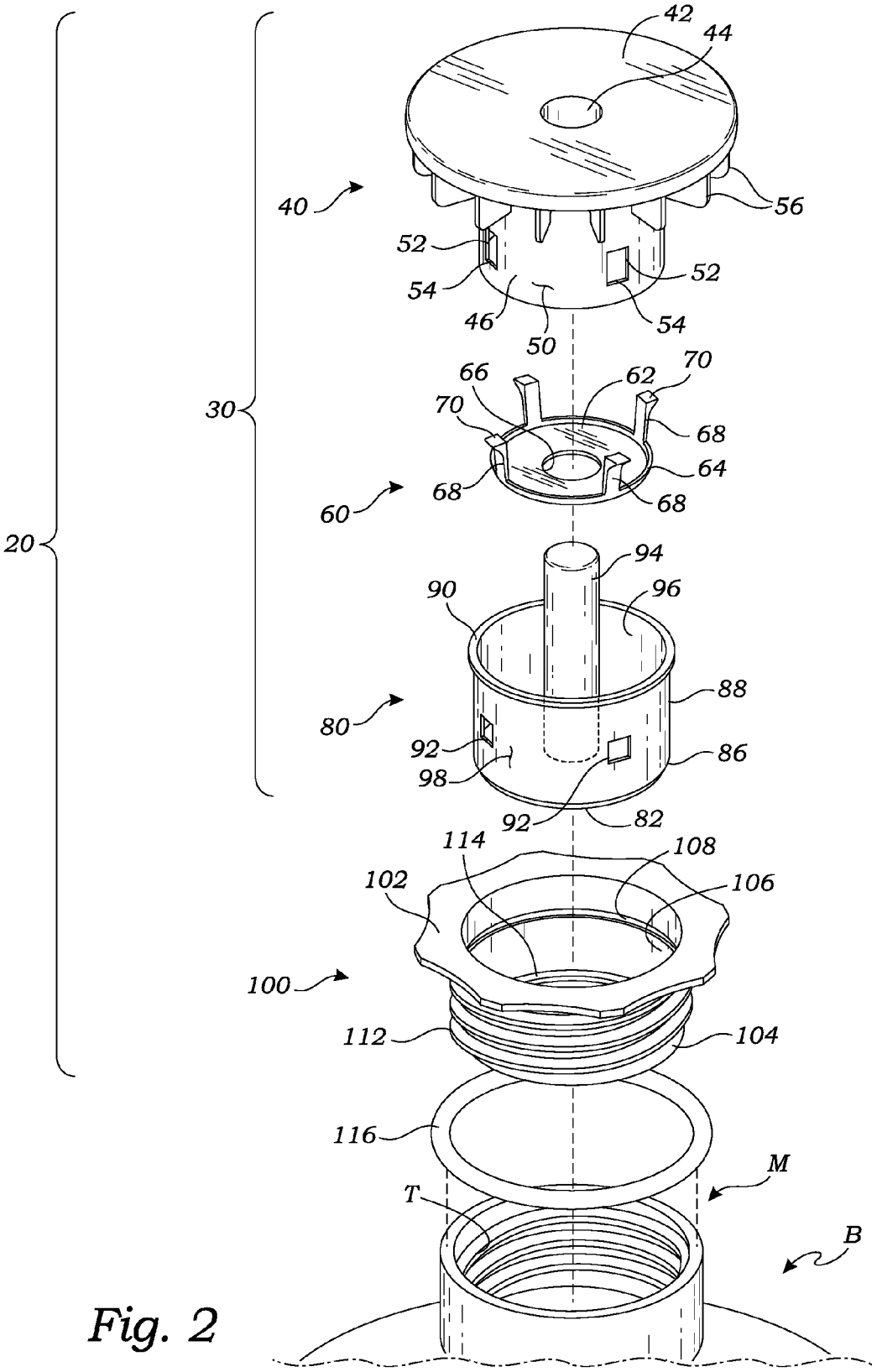
FIG. 2 is an enlarged fully-exploded perspective view thereof.

Referring further to FIG. 2 showing an enlarged fully-exploded perspective view of the apparatus 20, it can clearly be seen that the insert assembly 30 comprises in the exemplary embodiment a head 40, a latch 60, and a button 80, which together form the insert assembly 30 and work in concert to selectively engage the receiver 100 and thereby open or close the mouth M of the bottle B, as best appreciated from the cross-sectional views of FIGS. 4-6 described more fully below. Those skilled in the art will appreciate as a threshold matter that while the insert assembly 30 is shown as comprising three distinct components, fewer or more components may be employed and variations on each without departing from the spirit and scope of the invention. In the exemplary embodiment, first, the head 40 is shown as generally having a substantially round top 42 from which downwardly extends a substantially concentric head annular wall 46, with a substantially concentric top hole 44 communicating therebetween. Formed spaced about the head annular wall 46 are substantially rectangular head openings 52 communicating between the head annular wall inner surface 48 (FIG. 4) and the head annular wall outer surface 50, the purpose and function of which will be appreciated from the below discussion regarding the apparatus 20 in use in connection with FIG. 4-6. Further, fins 56 are shown as being formed integral with or interconnecting the top 42 and the head annular wall 46 spaced circumferentially thereabout and extending substantially radially therefrom. Next, the latch 60 is shown as having a substantially round latch base 62 having a substantially centered latch base hole 66 and a circumferential latch base perimeter 64 from which spaced-apart tines 68 extend substantially upwardly and outwardly from the latch base perimeter 64. Each such tine 68 terminates in a substantially radially-outwardly projecting tip 70. In the exemplary embodiment, there are four such tines 68 positioned about the latch base perimeter 64 substantially ninety degrees apart, such that there are thus formed four head openings 52 in the head annular wall 46 substantially ninety degrees apart so as to substantially correspond with the respective tines 68 and tips 70, as will again be appreciated from the below discussion relative to FIGS. 4-6. Finally in terms of the exemplary components of the insert assembly 30, the button 80 is shown as having a substantially round button base 82 terminating radially at its button base perimeter 86 in a substantially concentric upwardly-extending button annular wall 88. Analogous to the head openings 52, there are four substantially rectangular button openings 92 formed in the button annular wall 88 substantially ninety degrees apart for again accommodating or allowing the passage therethrough of the tine tips 70 of the latch 60, here communicating between a button annular wall inner surface 96 and an opposite button annular wall outer surface 98. In the exemplary embodiment, the button openings 92 are smaller than the head openings 52, but it will be appreciated that this is not necessary so long as there is sufficient clearance for the tines 70 and tips 72 through the respective openings 52, 92, more about which will again be said below in connection with the bottle cap apparatus 20 in use. As shown, the button 80 further is formed with a substantially concentric post 94 extending substantially upwardly from the button base 82 and having a size (length and diameter) sufficient to pass through both the latch base hole 66 and the head top hole 44 when the insert assembly 30 is assembled for use as shown in FIG. 1. In alternative embodiments it will be appreciated that the button 80 may be formed without a post 94 or the like at all, in which case the insert assembly 30 would be activated by simply pulling up on the head top 42, relying on the engagement of the tines 68 in the groove 108 to provide resistance to the upward travel of the latch 60 even as the head 40 travels upward, more about which is said below.

Figure 3:
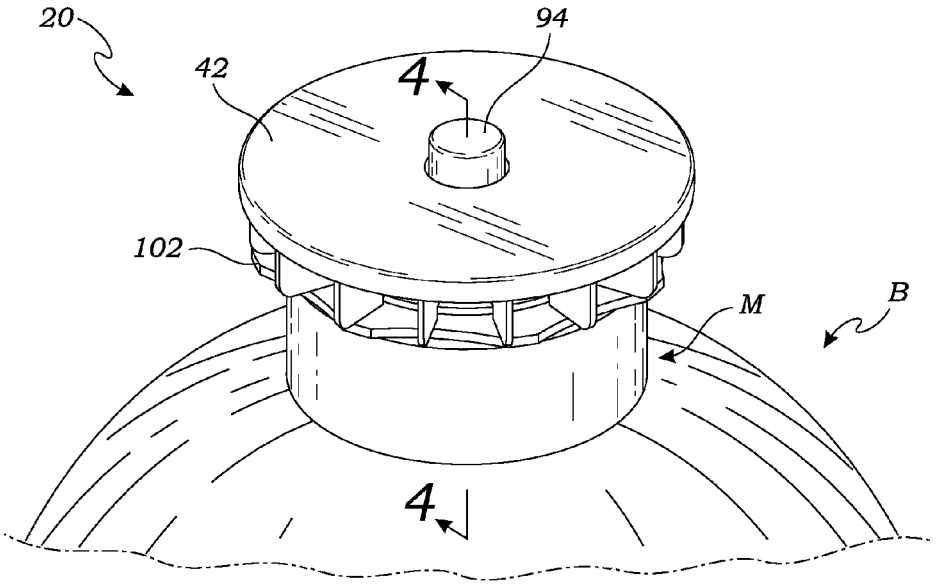
FIG. 3 is an enlarged perspective view thereof as completely installed within the mouth of a bottle.

With continued reference to FIG. 2 and now with further reference to FIG. 3 showing the receiver 100 installed in the mouth M of a bottle B and the insert assembly 30 now installed within the receiver 100, it can be seen that in the exemplary embodiment the receiver 100 is threaded or screwed into the mouth M until the threads 112 bottom out or the receiver flange 102 formed to extend radially outwardly from the upper end of the receiver annular wall 104 substantially seats against the mouth M or until the receiver 100 is otherwise snugly or tightly engaged within the mouth M. An optional o-ring 116 may be seated about the receiver annular wall 104 so as to seal and further secure the receiver 100 within or against the mouth M of the bottle B. While the receiver flange 102 is shown as having an irregular perimeter edge, it will be appreciated that any such structure or configuration now known or later developed for facilitating gripping the receiver 100 so as to screw or unscrew it from the bottle B may be employed in the present invention without departing from its spirit and scope. As also shown, the receiver 100 is formed on the receiver annular wall inner surface 106 with a circumferential groove 108 configured to selectively receive the tips 70 of the tines 68 of the latch 60 so as to selectively seat and secure the insert assembly 30 within the receiver 100. Once again, those skilled in the art will appreciate that other structure and configurations and related functionality of the various components comprising the exemplary bottle cap apparatus 20, whether now known or later developed, may be employed without departing from the spirit and scope of the present invention.

Figure 4:
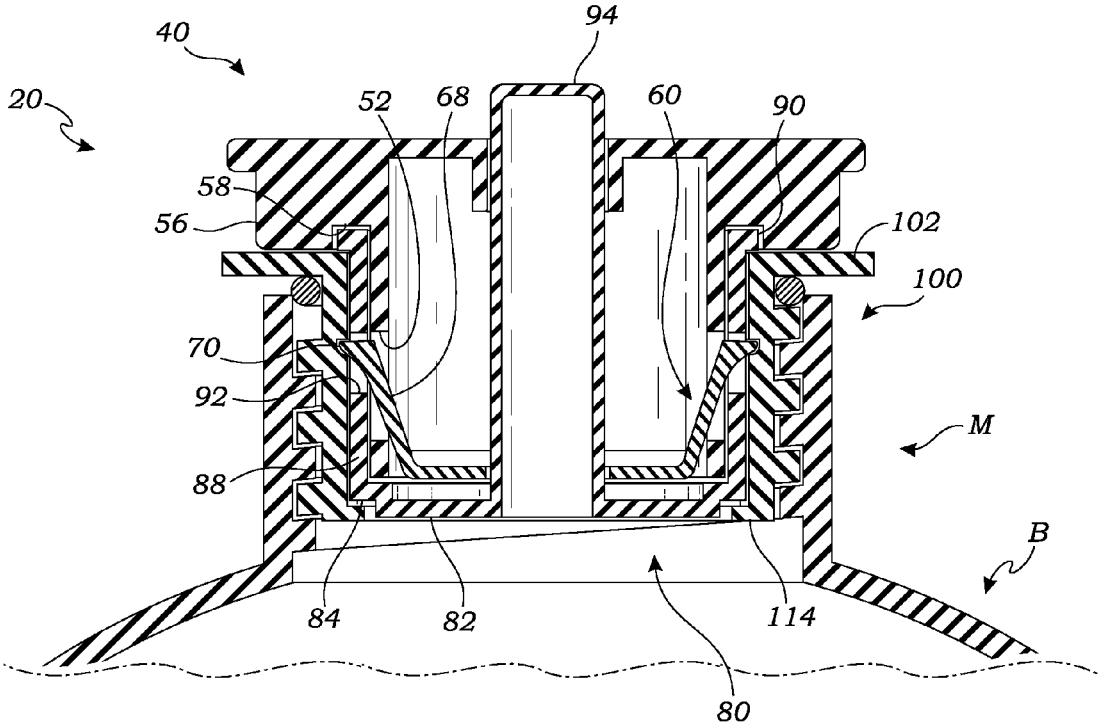
FIG. 4 is a cross-sectional view thereof taken along line 4-4 of FIG. 3, the bottle cap shown in a first operational configuration.

With continued reference to FIG. 2, but now turning as well to FIG. 4, there is shown a cross-sectional view of the bottle cap apparatus 20 of the present invention in a first operational configuration as in FIG. 3 wherein the exemplary receiver 100 is threadably secured in the mouth M of a bottle B and the insert assembly 30 is removably engaged within the receiver 100. As can be seen, in the exemplary embodiment, the three-part insert assembly 30 is formed by effectively installing the latch 60 on the button 80 such that the two parts operate in tandem. The latch base hole 66 may be sized and configured for an interference or press fit about the button post 94 or such engagement about the post 94 may be accomplished through a solvent bond, ultrasonic weld or the like. Or, in addition or instead, the latch base 62 may be affixed to the button base 82 again as by a solvent bond, ultrasonic weld or the like. Or further, the latch 60 may simply be formed integral with the button 80 at the outset, as through molding or over-molding or other such fabrication technique. It will be appreciated by those skilled in the art that any such manufacturing, fabrication, or assembly methods and related materials now known or later developed may be employed in securing the latch 60 relative to the button 80 without departing from the spirit and scope of the present invention. In any case, the latch tines 68, and the tips 70 particularly, are to be configured such that when the latch 60 is so assembled with the button 80 the tine tips 70 extend through the respective button openings 92 formed in the button annular wall 88. Or, in a further alternative embodiment, the latch 60 may float freely within the button 80 held in place spatially simply by the loose engagement of the tines 68 with the button annular wall 88 through the button openings 92. The latch 60 and button 80 so assembled, whether integral or loose, are then slidably installed within the head 40 from the bottom as by flexing the tines 68 inwardly so as to pass within the head annular wall 46, with specifically the tine tips 70 riding along the head annular wall inner surface 48 until the tips 70 pass through the head openings 52 and then back through the button openings 92, thereby effectively locking the latch 60 and button 80 within the head 40 with the button post 94 extending through the head top hole 44. As such, the three-part insert assembly 30 is thereby formed so as to remain operably together even as the insert assembly 30 is removed from the receiver 100 as shown in FIG. 1. In the exemplary embodiment, the head annular wall 46 is inside the button annular wall 88, or the head annular wall 46 is a slightly smaller diameter so as to position its outer surface 50 substantially adjacent the button annular wall 88, but it will be appreciated that other arrangements are possible and thus that the exemplary arrangement is merely illustrative of features and aspects of the present invention and non-limiting. For example, in an alternative arrangement, the button 80 may be formed without a button annular wall 88 and just essentially be the button base 82 with the upwardly extending post 94, with the annular wall for the assembly 30 and the openings 52 for the tines 68 being provided by the head annular wall 46 alone. By way of further example of the three-part insert assembly 30, it is also possible to instead first install the latch 60 on the head 40 as by flexing the spines 68 inwardly so as to again pass within the head annular wall 46, with specifically the tine tips 70 riding along the head annular wall inner surface 48 until the tips 70 pass through the head openings 52. With the latch 60 thus positioned within the head 40, the button 80 may be installed axially from the bottom by passing the post 94 through the latch base hole 66 and sliding the button annular wall 88 along the head annular wall 46 with the tine tips 70 riding along the button annular wall inner surface 96 until they find and enter the respective button openings 92, thereby once again forming the three-part insert assembly 30, with the latch 60 again serving to effectively couple the head 40 to the button 80 through the engagement of the tines 68 within the respective head and button openings 52, 92, with the head 40 having relatively more movement by virtue of the relatively longer openings 52, more about which will be said below in connection with the second operational configuration of the bottle cap apparatus 20 shown in FIG. 5. It will already be appreciated from the foregoing discussion with respect to each alternative means of assembling the resulting insert assembly 30 that the tines 68 are to be relatively resilient as achieved by a combination of their geometry (cross-section) and the material from which they are formed, which may be a stamped or formed metal such as aluminum or spring steel or a variety of injection-molded plastics. Ultimately, it will be appreciated that any such materials or methods of manufacture and assembly now known or later developed may be employed in the present invention without departing from its spirit and scope.

With further reference to FIGS. 2 and 4, in this first operational configuration of the cap bottle apparatus 20 shown in FIG. 4, there are effectively two mechanical stops for the insertion of the insert assembly 30 within the receiver 100, either or both of which can be employed. First, it can be seen that both a radially-outwardly projecting button annular wall lip 90 formed at the upper end of the button annular wall 88 opposite the button base 82 as well as the bottom edges of the fins 56 formed beneath the top 42 of the head 40 are each configured to substantially abut the receiver flange 102 when the insert assembly 30 is installed within the receiver 100, thereby limiting the downward travel of the insert assembly 30. Downwardly-opening fin undercuts 58 formed in the fins 56 substantially at their intersection with the head annular wall 46 provide clearance for the button annular wall lip 90. In addition, the button base 82 is shown as being formed with a circumferential, downwardly-facing button base step 84 substantially at the transition from the button base 82 to the button annular wall 88 at the button base perimeter 86 that is configured to engage or seat against a radially-inwardly extending receiver annular wall lip 114 formed at the bottom end of the receiver annular wall 104 substantially opposite the receiver flange 102, thereby providing an additional or alternative mechanical stop preventing or limiting further insertion of the insert assembly 30 into the receiver 100. Once again, those skilled in the art will appreciate that such features and their mechanical engagement or operation are merely illustrative of aspects of the present invention and are non-limiting.

In use, then, as shown in FIG. 4, in the first operational configuration as in FIG. 3 wherein the exemplary receiver 100 is threadably secured in the mouth M of a bottle B, the insert assembly 30 is removably engaged within the receiver 100 by simply inserting the insert assembly 30 axially downwardly into the receiver 100, whereby the tips 70 of the tines 68 would engage and slide along the receiver annular wall inner surface 106, with the tines 68 flexing inwardly as necessary, until the tips 70 entered the circumferential, inwardly-opening groove 108 formed within the receiver 100 on its annular wall inner surface 106 an appropriate distance down from the opening or from the flange 102. It will thus be appreciated that the "at rest" configuration of the latch 60 is such that the tines 68 extend upwardly and outwardly and the tips 70 then further outwardly so as to set a radial distance or actual circumference of the latch 60 at its maximum dimension that is substantially equivalent to the diameter at the deepest point in the groove 108, whereby once the tine tips 70 are positioned substantially adjacent to the groove 108, which position substantially corresponds to the insert assembly 30 being inserted to its full or allowed depth within the receiver 100, the tines 68 spring back to their "at rest" position causing the tine tips 70 to then enter the groove 108 and thereby "lock" the insert assembly 30 within the receiver 100. That is, once the tine tips 70 are engaged with the receiver groove 108, pulling up on the insert assembly 30 will simply cause the tine tip upper surface 72 to seat against the top of the groove 108 and not allow any further axially upward movement of the insert assembly 30 relative to the receiver 100. As such, it will appreciated that the installation of the insert assembly 30 within the receiver 100 in this manner as shown in FIGS. 3 and 4 and defines the first operational configuration of the bottle cap apparatus 20 as substantially "closed"—that is, the mouth M of the bottle B is effectively capped by the insert assembly 30. Though not shown for clarity in the cross-sectional view of FIG. 4, the mating or adjacent surfaces of the respective components, particularly between the button annular wall 88 and the receiver annular wall 104 beneath the button openings 92, may either involve net or interference fits or the use of gaskets, o-rings or the like to seal between such surfaces and thereby not allow any fluid contained in the bottle B to leak therebetween and out. It will be appreciated by those skilled in the art that any such sealing means now known or later developed as functioning on or adjacent or incorporated in a variety of surfaces of the mating components may be employed without departing from the spirit and scope of the present invention. By way of further non-limiting illustration, a rubber gasket may be installed on top of the radially-inwardly extending receiver annular wall lip 114 or in the region of the downwardly-facing button base step 84 so as to form a circumferential seal in that region when the insert assembly 30 is fully inserted into the receiver 100 and the tine tips 70 engaged with the groove 108 as described above so as to selectively secure the insert assembly 30 within the receiver 100. It will once again be appreciated that beyond the interference or net fit surfaces along the respective engaged threads T, 112 of the bottle mouth M and receiver 100, an o-ring 116 may be inserted therebetween, such as beneath the flange 102 between it and the wall of the mouth M to close off any flow path or possible leak from the bottle B there.

Figure 5:
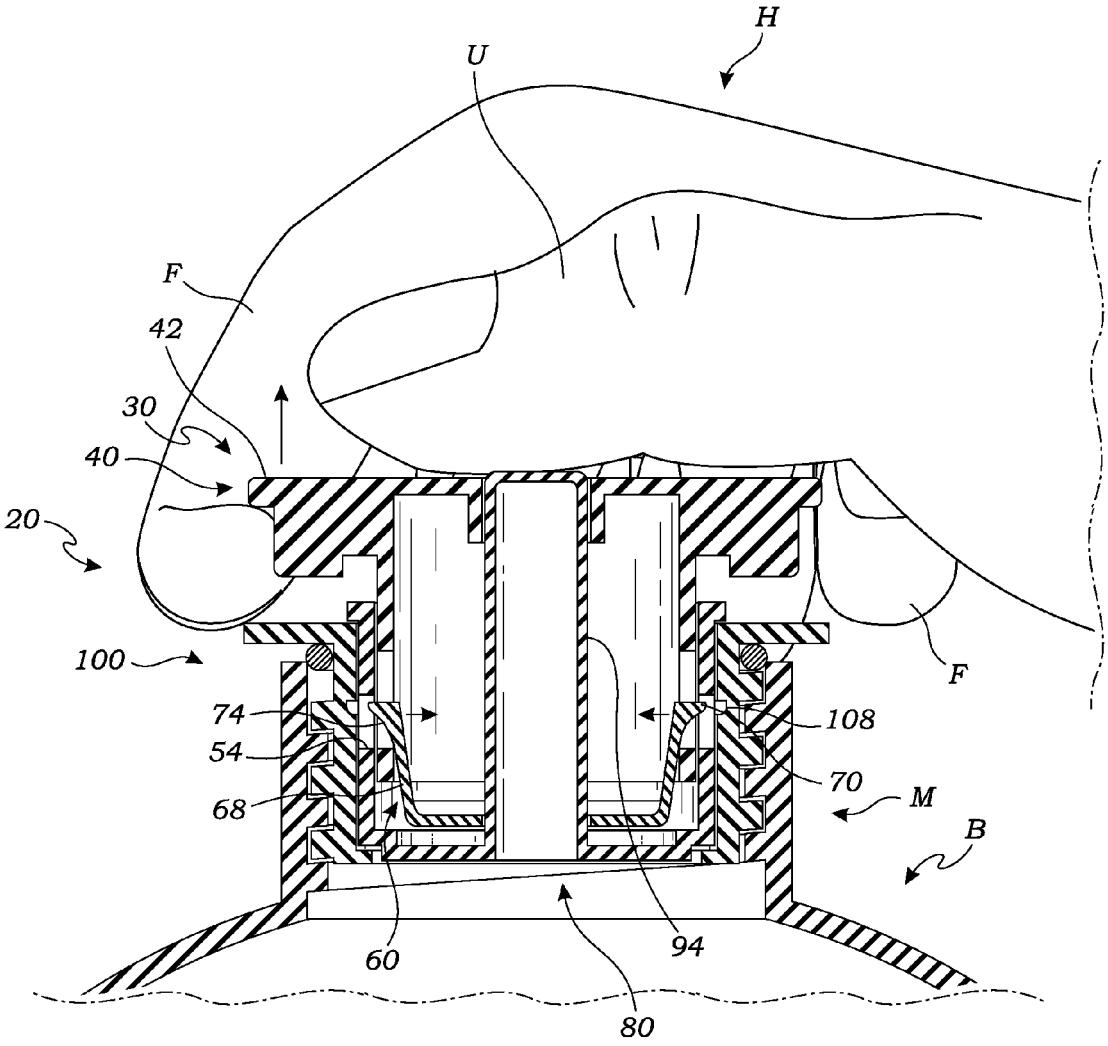
FIG. 5 is a cross-sectional view thereof in a second operational configuration.
Figure 6:
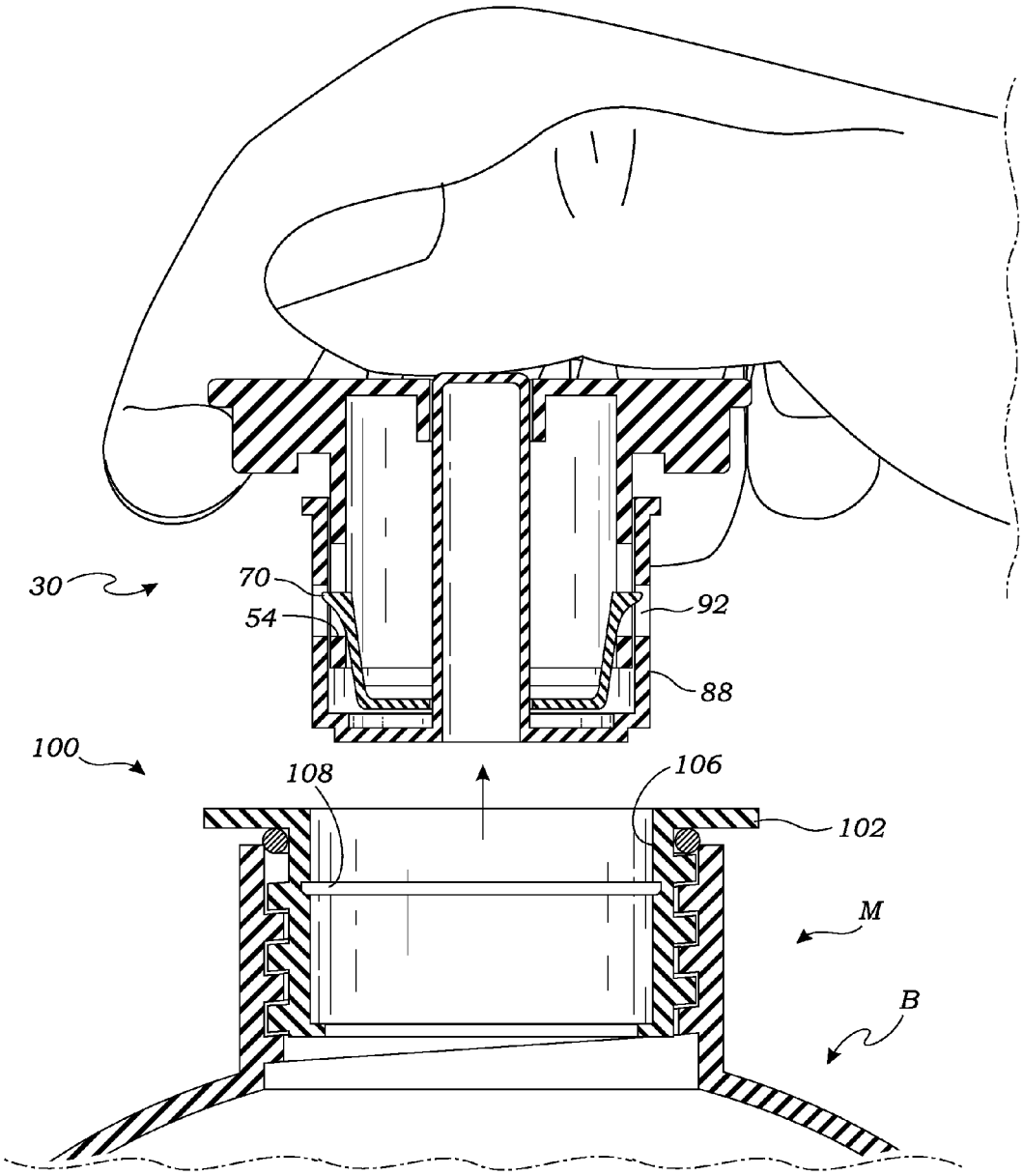
FIG. 6 is a cross-sectional view thereof in a third operational configuration.

Turning next to FIG. 5, to "open" the bottle B as by removing the insert assembly 30 from the receiver 100 threaded into the mouth M, a user first would simply with one hand H push down as with the thumb U on the post 94 of the button 80 while pulling up on the head 40 as by placing one or more fingers F beneath the top 42. This will cause, as shown, the head 40 to slide upwardly relative to the button 80 and the latch 60, whereby the tines 68 and perhaps even the somewhat curved tip lower surfaces 74 are forced to ride along the head opening bottom edge 54, which in turn squeezes or deflects the tines 68 inwardly and thereby disengages the tine tips 70 from the receiver groove 108 and withdraws the tine tips 70 within the button openings 92. Once the insert assembly 30 is in this second operational configuration, it may simply be withdrawn from the receiver 100 to access the bottle B interior for drinking, pouring, filling, and the like as shown in FIG. 6, thus defining a third operational configuration of the bottle cap apparatus 20 according to aspects of the present invention, with the cap or insert assembly 30 completely removed or disengaged from the bottle mouth M, and particularly the receiver 100 therein, which operational state is also shown in FIG. 1, except there with the hand H removed and the insert assembly 30 back to its "at rest" configuration with the tine tips 70 protruding from the button openings 92. Those skilled in the art will appreciate that removing the insert assembly 30 from the receiver so as to "open" the bottle B is thus a relatively simple and quick one-hand operation that involves essentially pulling up on the head 40 while holding the button 80 and latch 60 in place by keeping a finger F or thumb U on the button post 94. Once the insert assembly 30 is clear of the receiver 100, the head 40 and the button 80 can be released and the insert assembly 30 return to its "at rest" configuration as again shown in FIG. 1, with it being appreciated that the outward bias of the tines 68 serves to pull the head 40 back down relative to the button 80 so that the button post 94 again protrudes upwardly from the head top 42 and the tine tips 70 again protrude through the button openings 92. And then to "close" the bottle B the insert assembly 30 is simply reinserted into the receiver 100 until the latch 60 locks in place through the tines 68 again engaging the receiver groove 108. As such, those skilled in the art will appreciate that after the receiver 100 itself is initially threaded into the bottle mouth M, there is no longer any need to screw and unscrew any kind of cap or the like each time to close and open a bottle, saving time and trouble.

Figure 7:
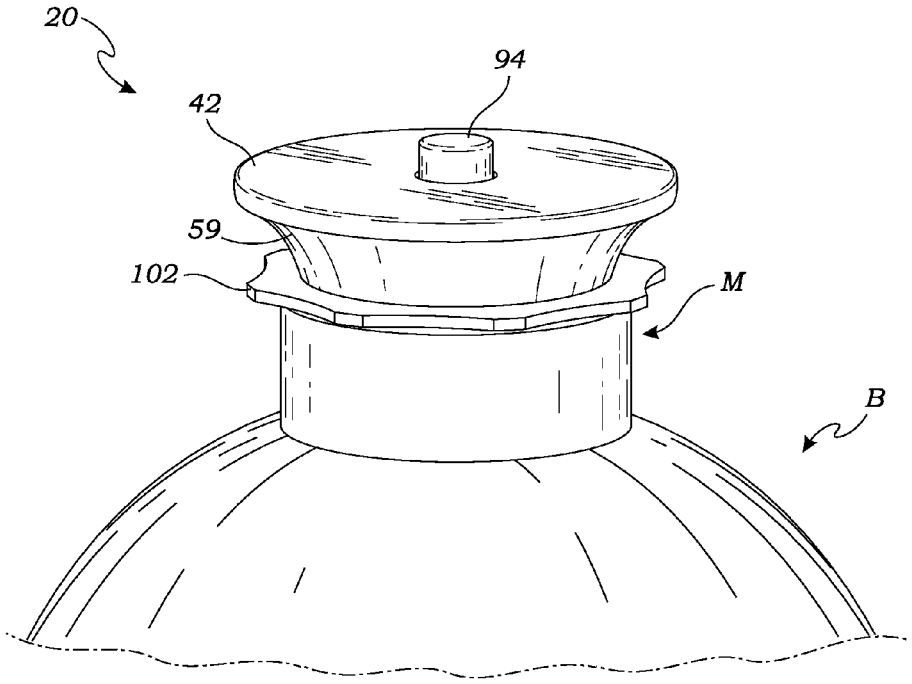
FIG. 7 is an enlarged perspective view of an alternative embodiment thereof as installed within the mouth of a bottle.

Turning briefly to FIG. 7, there is shown an enlarged perspective view of an alternative embodiment of the bottle cap apparatus 20 as installed within the mouth M of a bottle B. Particularly, rather than the spaced-apart, radially-extending fins 56 formed integral with or interconnecting and spanning the top 42 and the head annular wall 46 of the head 40 of the insert assembly 30 as in FIGS. 1-6, in the alternative arrangement, a tapered fillet 59 extends inwardly and downwardly from the top 42 and forms the circumferential surface thereunder transitioning to or substantially abutting the receiver flange 102 when the insert assembly 30 is removably received within the receiver 100 (FIGS. 1 and 2). As such, a smooth and somewhat curved surface in the exemplary embodiment is formed for grasping when installing or removing the insert assembly 30 in a manner analogous to that shown and described in connection with FIGS. 5 and 6. While a particular geometry or profile of the fillet 59 is shown, it will be appreciated that a variety of shapes and surface features or characteristics may be employed for the fillet 59 and the insert assembly 30 more generally without departing from the spirit and scope of the invention. It is further noted, though not shown in FIG. 7, that a notch or other relief such as the downwardly-opening undercuts 58 formed in the fins 56 as best seen in FIG. 4 may similarly still be incorporated in the bottom or downwardly-facing surface of the fillet 59 so as to accommodate the radially-outwardly projecting button annular wall lip 90 formed at the upper end of the button annular wall 88 of the button 80. Once again, those skilled in the art will appreciate that any such structure and mating surfaces may be incorporated in the bottle cap apparatus 20 without departing from its spirit and scope, such that any of the exemplary embodiments are to be understood as merely illustrating features and aspects of the invention and expressly be non-limiting.

To summarize, regarding the exemplary embodiments of the present invention as shown and described herein, it will be appreciated that a bottle cap apparatus is disclosed and configured for selectively engaging and opening and closing the mouth of a bottle. Because the principles of the invention may be practiced in a number of configurations beyond those shown and described, it is to be understood that the invention is not in any way limited by the exemplary embodiments, but is generally directed to a bottle cap apparatus for operating in conjunction with a bottle having a mouth, the apparatus comprising a receiver configured with a means for engaging the mouth of the bottle and an insert assembly configured to be removably engaged with the receiver so as to selectively open and close the mouth of the bottle, and so is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention. Furthermore, the various features of each of the above-described embodiments may be combined in any logical manner and are intended to be included within the scope of the present invention.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A bottle cap apparatus for operating in conjunction with a bottle having a mouth, the apparatus comprising:

a receiver configured for engaging the mouth of the bottle, the receiver comprising a receiver annular wall having a receiver annular wall inner surface formed with a circumferential groove; and an insert assembly configured to be removably engaged with the receiver so as to selectively open and close the mouth of the bottle, the insert assembly comprising a latch having a latch base formed with at least one resilient tine extending substantially upwardly and outwardly therefrom and terminating in a substantially radially-outwardly projecting tip, the tip being configured to seat within the groove and thereby selectively secure the insert assembly within the receiver.

2. The apparatus of claim 1 wherein the insert assembly further comprises:

a head having a top from which downwardly extends a head annular wall and a substantially concentric top hole communicating therebetween, the head further formed with at least one head opening in the head annular wall so as to communicate between a head annular wall inner surface and a head annular wall outer surface thereof; and a button having a substantially round button base terminating radially at a button base perimeter in a substantially concentric upwardly-extending button annular wall, the button further formed with at least one button opening in the button annular wall so as to communicate between a button annular wall inner surface and a button annular wall outer surface thereof, the button further formed having a substantially concentric post extending substantially upwardly from the button base and configured to pass through the head top hole; wherein:

the head annular wall and the button annular wall are configured to be substantially concentric and adjacent such that the head opening and the button opening are substantially aligned; and the latch is installed within the head and button annular walls as by passing the post of the button through a substantially central latch base hole formed in the latch base such that the latch base is positioned substantially adjacent to the button base and the at least one tine protrudes through the respective head and button openings, whereby in a first operational configuration of the apparatus with the insert assembly removably secured within the receiver, the tip of the at least one tine extends through the at least one head and button openings and is seated within the groove of the receiver, and further whereby in a second operational configuration upon axial movement of the head relative to the button as by pushing on the post of the button while pulling up on the top of the head, the tine is deflected inwardly by one of the head and button openings so as to retract the tip therein and so unseat the tip from the groove and thus allow removal of the insert assembly from the receiver, thereby selectively opening the bottle.

3. The apparatus of claim 2 wherein:

four substantially rectangular head openings are formed in the head annular wall substantially ninety degrees apart;

four substantially rectangular button openings are formed in the button annular wall substantially ninety degrees apart; and four tines substantially ninety degrees apart extend substantially upwardly and outwardly from a latch base perimeter of the latch base, whereby the tines are configured to pass through the respective head and button openings.

4. The apparatus of claim 2 wherein:

the head annular wall is within the button annular wall such that the button annular wall inner surface is substantially adjacent to the head annular wall outer surface; and the at least one head opening is larger than the at least one button opening, such that the at least one tine is configured to ride on the head opening bottom edge as the head moves axially relative to the button for selectively flexing the tine inwardly so as to disengage the tip thereof from the groove of the receiver and allow the insert assembly to be removed from the receiver.

5. The apparatus of claim 2 wherein:

the button base is formed having a circumferential, downwardly-facing button base step substantially at the button base perimeter; and the receiver is formed having a radially-inwardly extending receiver annular wall lip formed on the receiver annular wall substantially opposite a receiver flange integral with the receiver annual wall, thereby limiting further insertion of the insert assembly into the receiver.

6. The apparatus of claim 2 wherein:

the head is further formed having fins interconnecting the top and the head annular wall spaced circumferentially thereabout and extending substantially radially therefrom, the fins being further formed with downwardly-opening fin undercuts substantially at the intersection of the fins with the head annular wall; and a radially-outwardly projecting button annular wall lip is formed on the button annular wall opposite the button base and configured to seat on a receiver flange integral with the receiver annual wall and further configured to be received within the fin undercuts, whereby both the button annular wall lip and the fins are configured to substantially abut the receiver flange when the insert assembly is installed within the receiver, thereby limiting further insertion of the insert assembly into the receiver.

7. The apparatus of claim 2 wherein:

the head is further formed having a tapered fillet interconnecting the top and the head annular wall extending circumferentially thereabout; and a radially-outwardly projecting button annular wall lip is formed on the button annular wall opposite the button base and configured to seat on a receiver flange integral with the receiver annual wall, whereby both the button annular wall lip and the fillet are configured to substantially abut the receiver flange when the insert assembly is installed within the receiver, thereby limiting further insertion of the insert assembly into the receiver.

8. The apparatus of claim 1 wherein:

the mouth of the bottle comprises internal threads corresponding external threads formed on a receiver annular wall outer surface of the receiver annular wall; and a receiver flange is formed on the receiver to facilitate grasping the receiver so as to threadably engage or disengage the receiver from the mouth of the bottle.

9. The apparatus of claim 1 wherein the insert assembly further comprises:

a head having a top from which downwardly extends a head annular wall, the head further formed with four substantially rectangular head openings in the head annular wall substantially ninety degrees apart so as to communicate between a head annular wall inner surface and a head annular wall outer surface thereof; and a button having a substantially round button base terminating radially at a button base perimeter in a substantially concentric upwardly-extending button annular wall, the button further formed with four substantially rectangular button openings in the button annular wall substantially ninety degrees apart so as to communicate between a button annular wall inner surface and a button annular wall outer surface thereof; wherein:

the head annular wall and the button annular wall are configured to be substantially concentric and adjacent such that the head openings and the button openings are substantially aligned; and the latch is formed having four tines substantially ninety degrees apart extending substantially upwardly and outwardly from a latch base perimeter of the latch base and is installed within the head and button annular walls such that the latch base is positioned substantially adjacent to the button base and the tines protrude through the respective head and button openings, whereby in a first operational configuration of the apparatus with the insert assembly removably secured within the receiver, the tips of the tines extend through the head and button openings and are seated within the groove of the receiver, and further whereby in a second operational configuration upon axial movement of the head relative to the button as by pulling up on the top of the head, the tines are deflected inwardly by respective ones of the head and button openings so as to retract the tips therein and so unseat the tips from the groove and thus allow removal of the insert assembly from the receiver, thereby selectively opening the bottle.

10. The apparatus of claim 1 wherein the insert assembly further comprises:

a head having a top from which downwardly extends a head annular wall and a substantially concentric top hole communicating therebetween, the head further formed with at least one head opening in the head annular wall so as to communicate between a head annular wall inner surface and a head annular wall outer surface thereof; and a button having a substantially round button base, the button further formed having a substantially concentric post extending substantially upwardly from the button base and configured to pass through the head top hole; wherein:

the latch is installed within the head annular wall as by passing the post of the button through a substantially central latch base hole formed in the latch base such that the latch base is positioned substantially adjacent to the button base and the at least one tine protrudes through the at least one head opening, whereby in a first operational configuration of the apparatus with the insert assembly removably secured within the receiver, the tip of the at least one tine extends through the at least one head opening and is seated within the groove of the receiver, and further whereby in a second operational configuration upon axial movement of the head relative to the button as by pushing on the post of the button while pulling up on the top of the head, the tine is deflected inwardly by the head opening so as to retract the tip therein and so unseat the tip from the groove and thus allow removal of the insert assembly from the receiver, thereby selectively opening the bottle.

11. A bottle cap apparatus for operating in conjunction with a bottle having a mouth, the apparatus comprising:

a receiver configured for engaging the mouth of the bottle and further comprising a receiver annular wall having a receiver annular wall inner surface formed with an inwardly-opening circumferential groove; and an insert assembly configured to be removably engaged with the receiver, the insert assembly comprising a latch having a latch base formed with a plurality of spaced-apart resilient tines extending substantially upwardly and outwardly therefrom and each terminating in a substantially radially-outwardly projecting tip, the tips being configured to seat within the groove and thereby selectively secure the insert assembly within the receiver so as to selectively open and close the mouth of the bottle.

12. The apparatus of claim 11 wherein the insert assembly further comprises a head having a top from which downwardly extends a head annular wall and a substantially concentric top hole communicating therebetween, the head further formed with a plurality of spaced-apart substantially rectangular head openings in the head annular wall so as to communicate between a head annular wall inner surface and a head annular wall outer surface thereof and receive therein the respective tines of the latch.

13. The apparatus of claim 12 wherein the insert assembly further comprises a button having a substantially round button base terminating radially at a button base perimeter in a substantially concentric upwardly-extending button annular wall, the button further formed with a plurality of spaced-apart substantially rectangular button openings in the button annular wall so as to communicate between a button annular wall inner surface and a button annular wall outer surface thereof, the button further formed having a substantially concentric post extending substantially upwardly from the button base and configured to pass through the top hole of the head, the head annular wall and the button annular wall being configured to be substantially concentric and adjacent such that the respective head openings and button openings are substantially aligned, the latch being installed within the head and button annular walls as by passing the post of the button through a substantially central latch base hole formed in the latch base such that the latch base is positioned substantially adjacent to the button base and the tines protrude through the respective head and button openings, whereby in a first operational configuration of the apparatus with the insert assembly removably secured within the receiver, the tips of the tines extend through the respective head and button openings and are seated within the groove of the receiver, and further whereby in a second operational configuration upon axial movement of the head relative to the button as by pushing on the post of the button while pulling up on the top of the head, the tines are deflected inwardly by the respective ones of the head and button openings so as to retract the tips therein and so unseat the tips from the groove and thus allow removal of the insert assembly from the receiver, thereby selectively opening the bottle.

14. A bottle cap apparatus for operating in conjunction with a bottle having a mouth, the apparatus comprising:

a receiver configured for engaging the mouth of the bottle and further comprising a receiver annular wall having a receiver annular wall inner surface formed with an inwardly-opening circumferential groove; and an insert assembly configured to be removably engaged with the receiver, the insert assembly comprising:

a head having a top from which downwardly extends a head annular wall and a substantially concentric top hole communicating therebetween, the head further formed with a plurality of spaced-apart substantially rectangular head openings in the head annular wall so as to communicate between a head annular wall inner surface and a head annular wall outer surface thereof;

a button having a substantially round button base terminating radially at a button base perimeter in a substantially concentric upwardly-extending button annular wall, the button further formed with a plurality of spaced-apart substantially rectangular button openings in the button annular wall so as to communicate between a button annular wall inner surface and a button annular wall outer surface thereof, the button further formed having a substantially concentric post extending substantially upwardly from the button base and configured to pass through the top hole of the head, the head annular wall and the button annular wall being configured to be substantially concentric and adjacent such that the respective head openings and button openings are substantially aligned; and a latch having a latch base formed with a plurality of spaced-apart resilient tines extending substantially upwardly and outwardly therefrom and each terminating in a substantially radially-outwardly projecting tip, the latch being installed within the head and button annular walls as by passing the post of the button through a substantially central latch base hole formed in the latch base such that the latch base is positioned substantially adjacent to the button base and the tines protrude through the respective head and button openings, the tips being configured to seat within the groove and thereby selectively secure the insert assembly within the receiver, whereby in a first operational configuration of the apparatus with the insert assembly removably secured within the receiver, the tips of the tines extend through the head and button openings and are seated within the groove of the receiver, and further whereby upon axial movement of the head relative to the button as by pushing on the post of the button while pulling up on the top of the head, the tines are deflected inwardly by respective ones of the head and button openings so as to retract the tips therein and so unseat the tips from the groove and thus allow removal of the insert assembly from the receiver, thereby selectively opening the bottle.

* * * * *